US010577837B2

(12) United States Patent
Debroucke et al.

(10) Patent No.: US 10,577,837 B2
(45) Date of Patent: Mar. 3, 2020

(54) LOCK FOR A MOTOR VEHICLE

(71) Applicant: U-SHIN FRANCE, Creteil (FR)

(72) Inventors: François Debroucke, Creteil (FR); Laurent Duriez, Creteil (FR); Cédric Lamidon, Creteil (FR)

(73) Assignee: U-SHIN FRANCE, Creteil (FR)

( * ) Notice: Subject to any disclaimer, the term of this patent is extended or adjusted under 35 U.S.C. 154(b) by 550 days.

(21) Appl. No.: 15/313,396

(22) PCT Filed: May 28, 2015

(86) PCT No.: PCT/EP2015/061893

§ 371 (c)(1),
(2) Date: Nov. 22, 2016

(87) PCT Pub. No.: WO2015/181319

PCT Pub. Date: Dec. 3, 2015

(65) Prior Publication Data

US 2017/0198504 A1 Jul. 13, 2017

(30) Foreign Application Priority Data

May 28, 2014 (EP) ..... 14305807
Dec. 12, 2014 (EP) ..... 14307021

(51) Int. Cl.
*E05B 77/06* (2014.01)
*E05B 77/02* (2014.01)
(Continued)

(52) U.S. Cl.
CPC ..... *E05B 77/06* (2013.01); *E05B 77/02* (2013.01); *E05B 77/04* (2013.01); *E05B 77/08* (2013.01);
(Continued)

(58) Field of Classification Search
CPC ..... E05B 77/06; E05B 77/04; E05B 77/02; E05B 77/08; Y10T 292/0898;
(Continued)

(56) References Cited

U.S. PATENT DOCUMENTS 5,052,728 A * 10/1991 Fukumoto ..... B60N 3/102 224/281
6,158,788 A * 12/2000 Ikeda ..... E05B 81/06 292/216
(Continued)

FOREIGN PATENT DOCUMENTS

DE 195 11 651 A1 10/1995
DE 10 2011 010815 A1 8/2012
EP 1 371 799 A2 12/2003

OTHER PUBLICATIONS

International Search Report issued in PCT/EP2015/061893, dated Sep. 4, 2015 (2 pages).
(Continued)

*Primary Examiner* — Carlos Lugo
*Assistant Examiner* — Faria F Ahmad
(74) *Attorney, Agent, or Firm* — Burris Law, PLLC

(57) ABSTRACT

The invention relates to a lock (1) for an openable body section of a motor vehicle including: a lever (10) for opening said openable body section intended for allowing the opening of the openable body section; a locking means (12) configured to adopt an operative locking position in which said locking means (12) locks said opening lever (10) and an inoperative position in which said locking means (12) allows the movement of said lever (10); a resilient locking return means (14) configured so as to move said locking means (12) from the inoperative position to the operative locking position; and a triggering means (16) configured so as to adopt an inoperative position in which said triggering means (16) locks the locking means (12) in the inoperative position
(Continued)

thereof and an operative unlocking position in which said trigger (16) releases said locking means (12) in order for the later to pass from the inoperative position to the operative locking position, the opening lever (10) including a driving means (11*c*) configured to move the locking means (12) from the operative locking position to the inoperative position when the opening lever (10) pivots towards the direction in which the openable body section opens.

12 Claims, 3 Drawing Sheets

(51) Int. Cl.
*E05B 77/08* (2014.01)
*E05B 77/04* (2014.01)

(52) U.S. Cl.
CPC .... *Y10T 292/0898* (2015.04); *Y10T 292/0908* (2015.04); *Y10T 292/1043* (2015.04); *Y10T 292/1051* (2015.04); *Y10T 292/1056* (2015.04)

(58) Field of Classification Search
CPC ..... Y10T 292/0908; Y10T 92/1043; Y10T 292/1051; Y10T 292/1056
See application file for complete search history.

(56) References Cited

U.S. PATENT DOCUMENTS 6,471,259 B1 * 10/2002 Weyerstall ..... E05B 81/14 292/201
7,399,008 B2 * 7/2008 Leopold ..... B60R 7/04 292/238
7,571,948 B2 * 8/2009 Suh ..... B60R 7/06 292/DIG. 22
7,959,202 B2 * 6/2011 Ahn ..... E05B 83/30 296/1.04
2006/0261598 A1 * 11/2006 Leopold ..... B60R 7/04 292/1
2006/0261603 A1 * 11/2006 Cetnar ..... E05B 77/06 292/216
2007/0085349 A1 * 4/2007 Merideth ..... E05B 77/06 292/183
2007/0246944 A1 * 10/2007 Sundararajan ..... B60R 21/38 292/92
2009/0038225 A1 * 2/2009 Suh ..... B60R 7/06 49/31
2009/0243307 A1 * 10/2009 Lee ..... E05B 77/06 292/93
2013/0221690 A1 * 8/2013 Rocci ..... E05B 77/06 292/336.3
2013/0300134 A1 * 11/2013 Jayasuriya ..... E05B 77/08 292/129
2014/0001774 A1 * 1/2014 Bendel ..... E05B 77/06 292/200
2014/0175808 A1 * 6/2014 Faust ..... E05B 77/04 292/95
2014/0203575 A1 * 7/2014 Brickner ..... E05B 77/12 292/341.17
2017/0191290 A1 * 7/2017 Estrada ..... E05B 77/06

OTHER PUBLICATIONS

Written Opinion of the International Searching Authority issued in PCT/EP2015/061893, dated Sep. 4, 2015 (6 pages).

* cited by examiner

LOCK FOR A MOTOR VEHICLE

The present invention concerns a lock for motor vehicle.

A motor vehicle lock is intended to be mounted on a door leaf of motor vehicle and typically includes a bolt intended to be pivoted around a strike fastened on the structure of the motor vehicle in order to ensure the closing of the door leaf. The opening of the door leaf is performed by a rotation of the bolt in the opposite direction. Under normal conditions of use, the rotation in opposite direction, called<< opening direction of the door leaf>> is performed by the displacement of the outer handle which is linked to the lock by a control means which acts on an opening lever called outer lever in order to pivot the latter which releases, in turn, the bolt via a gripping device in the desired direction.

However, in case of lateral shock, the inertial force exerted on the door leaf can exert sufficient traction on the control means and act on the opening lever in order to control the opening of the lock and therefore the release of the door leaf.

In order to avoid this, there are locks configured for not having movement of kinematic during a shock or inhibiting the effect of the movement. Thus, there are provided blocking solutions of the kinematic chain by resistant stress, such as the springs, or by blocking. This last solution allows a better robustness of the lock vis-a-vis different families of shock.

The lock blocking can be performed by an external obstacle generating a deformation, due to a temporary or permanent inertial movement, with a possibility of resetting after shock in this last case.

The blocking by external obstacle is typically performed by a system which takes action by deformation of the door. If a deformation is greater than a threshold value, therefore there is an obstacle external to the lock which blocks the movement of the opening chain.

The blocking instruction typically comes from the deformation of the sheet metal of the vehicle. The deformation of this sheet metal will position an obstacle belonging to either the lock or to the sheet metal, in front of the outer opening lever. The lever directly taking action in the opening of the lock, the latter cannot be done.

However, such a system requires an adaptation to the geometry of the door, a deformation of said door, an insensitivity to the movement of the handle and the impossibility of opening the door after the shock.

There is the temporary blocking by inertial movement performed by a system which reacts to abnormal acceleration of the lock. If the value and the duration of the acceleration are greater than a threshold value, then a connecting rod is displaced to block the opening or declutch the movement.

In these designs, a locking block with spring is typically gripped to the outside opening lever. An inertial stress displaces said block on the side during the movement of said lever. A chute accommodates the block and prevents it to descend again the time that the outer opening lever is activated. The outer opening lever which cannot be activated, there is no opening. In these designs, the block returns to its initial position during the return to the rest position of the opening lever.

However, this system requires a good knowledge of the shock, in particular of the movement of the handle in case of shock and a setting of the synchronization of the setting movements.

An object of the invention is to provide a lock for a motor vehicle which allows prohibiting an external or internal opening under the effect of an inertial force, either single or multiple, applied to the lock during a car accident, while allowing, once the inertial force turned back into zero, the reopening of the lock without exhibiting the drawbacks of the prior art.

To this end, the object of the invention is a lock for a motor vehicle door leaf including:

- an opening lever of said door leaf intended for allowing the opening of the door leaf,
- a blocking means configured to take an active blocking position in which said blocking means blocks said opening lever and a rest position in which said blocking means allows the movement of said lever,
- a blocking elastic return means configured to switch said blocking means from the rest position to the active blocking position, and
- a trigger means configured to take a rest position in which said trigger means blocks the blocking means in its rest position and an active unblocking position in which said trigger releases said blocking means so that the latter passes from the rest position to the active blocking position,
- the opening lever including a driving means configured to bring the blocking means from the active blocking position to the rest position when the opening lever is pivoted towards the opening direction of the door leaf.

The lock of the present invention thus allows having an effective blocking of the door and avoiding the opening of the lock for a movement of the opening lever. Said lock exhibits the advantage of being capable to reset the blocking system in the initial position under the effect of a simple traction operation of the opening lever after the shock.

Such a blocking system is advantageously independent of the geometry of the door, of the movement of the handle, does not generate stress on the kinematic chain, does not require a delicate setting and is independent of the geometrical constraints.

According to preferred embodiments, the lock for motor vehicle according to the invention includes one or more of the following characteristics, taken separately or in combination:

- the cam of the opening lever supports the driving means in the form of a protrusion;
- the cam of the opening lever includes a protrusion, of the hook type, formed by a stop of structure defining a recess intended for receiving a portion of the blocking means when the latter is in the active blocking position so as to block the movement of the opening lever;
- the blocking means includes at least one elastic arm configured to change the length of the blocking means in order to disengage the elastic return means relative to the blocking means;
- the blocking elastic return means includes a first end able to come under a stop belonging to the blocking means and a second end able to be fastened to a fixed member of the lock;
- the blocking means includes a ramp allowing the blocking elastic return means to return under the stop when said blocking means is back in the rest position, in particular when said blocking means passes from the active blocking position to the rest position, which allows reactivating the blocking elastic return means relative to the blocking means;
- the protrusion is configured to receive the end of the blocking elastic return means and to drive the latter under the stop of the blocking means when the blocking means has been brought to the rest position;

the blocking means includes an elastic tab abutting against a fixed member of the lock and intended to exert a return force on the blocking means when the latter is in the active blocking position;

the trigger means is associated with a unblocking elastic return means configured to allow the passage of the trigger means from the active unblocking position to the rest position;

the trigger means is movable in translation through the elastic return means, such as a compression spring, fastened to the trigger means and to a fixed member of the lock;

the trigger means includes a protrusion coming substantially in or on a complementary notch present in the blocking means;

the blocking means is disposed in the lock in the rest position so that at each rotation of the opening lever in the direction of opening of the door leaf and when the blocking means is in the rest position, the blocking means and the opening lever come into contact, which allows, at each opening, a slight movement of the blocking means, of the blocking elastic return means, of the trigger means and of the elastic return means of the trigger means.

The invention also relates to a motor vehicle including a door leaf and a lock intended for opening and closing said door leaf.

Other advantages and characteristics will appear on reading the description of the invention given by way of example, as well as the appended figures in which.

Figure 2:
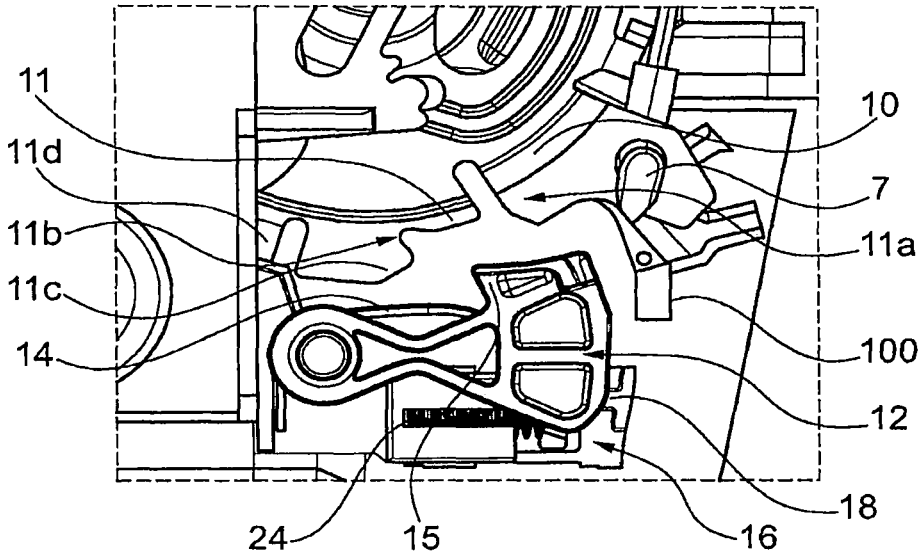
FIGS. 2 to 4 are front and perspective views of one embodiment of a lock of the invention.
Figure 3:
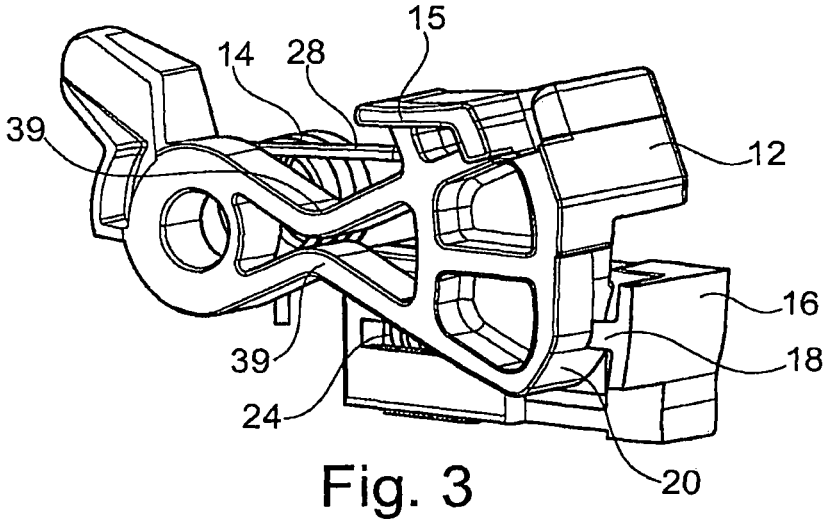
Figure 4:
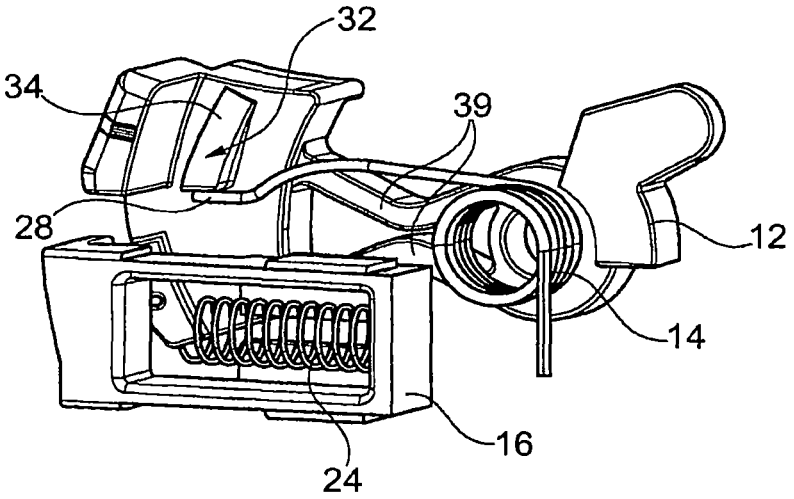
Figure 5:
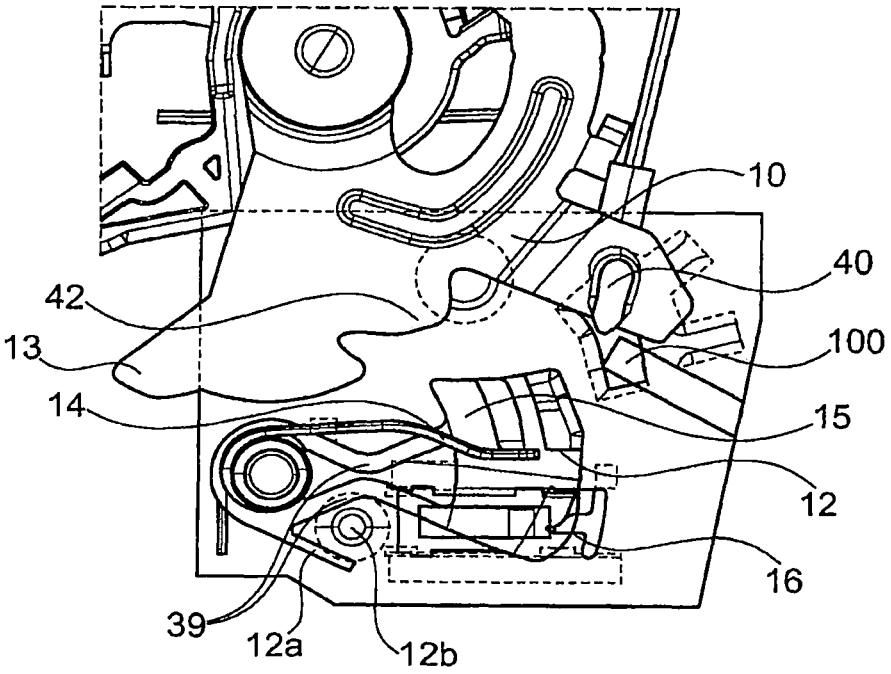
FIG. 5 is a partial schematic front view of a variant of the embodiment of FIGS. 2 to 4 comprising an elastic tab acting on the blocking means.

FIGS. 6*a* to 6*f* are front views of the embodiment of FIGS. 2 to 4 in operation.

The lock of the invention includes two types of opening lever: an intermediate opening lever and an outer opening lever. The outer opening lever is connected via a cable, such as the Bowden cable, or a rod to the outer handle and the intermediate opening lever is connected to other kinematic members of the motor vehicle located within said vehicle, such as the inner handles.

Figure 1:
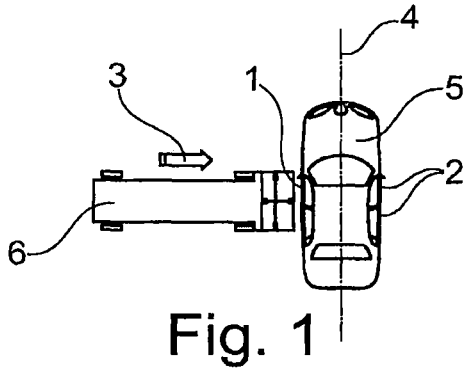
FIG. 1 is a partial top view of a vehicle subjected to a lateral shock.

As shown in FIG. 1, the lock of the invention 1 is adapted to open any type of door leaf of a motor vehicle, in particular a lateral door 2.

In this FIG. 1, an example of a lateral shock along a direction 3 substantially perpendicular to the main axis 4 of the motor vehicle 5 is illustrated. The shock may be generated by any kind of member, herein a motor vehicle 6 is shown. Such a shock acts on the handle in the direction of the opening of the latter along an oscillating movement comprising one or more phases in which the rod or the cable are pulled thereby generating the opening of the lock.

As schematically shown in FIGS. 2 to 5, said lock 1 includes a blocking system comprising:

an opening lever 10 intended to allow the opening of the door leaf 2, a blocking means 12 configured to take an active blocking position in which said blocking means 12 blocks said opening lever 10 and a rest position in which said blocking means 12 allows the movement of said lever 10, a blocking elastic return means 14 configured to switch said blocking means 12 from the rest position to the active blocking position, and a trigger means 16 configured to take a rest position in which said trigger means 16 blocks the blocking means 12 in its rest position and an active unblocking position in which said trigger means 16 releases said blocking means 12 so that the latter passes from the rest position to the active blocking position.

In the embodiment shown in the figures, the lever 10 is connected to the handle of the door leaf 2 via the Bowden cable 7. As seen in FIG. 2, the lever 10 includes a cam 11 movable in rotation along an axis of rotation, when a traction is exerted on the Bowden cable 7.

The opening lever 10 further includes a driving means, such as a first protrusion or stop 11*c* in order to allow the blocking means 12 to pass from the active position to the rest position when the opening lever 10 is pivoted towards the direction of the opening of the door leaf 2.

Thus, in a first variant of the solution shown in FIG. 2, the driving means is supported by the cam 11 in the form of at least one protrusion 11*c* which allows the is passage, or even the ejection of the means of the blocking 12 in the rest position. In a second variant illustrated in FIG. 5, it is the blocking means 12 which is itself provided with an elastic tab 12*a* in order to ensure this passage. The elastic tab 12*a* is typically abutting against a fixed member 12*b* of the lock of the invention and intended to exert a return force on the blocking means 12 when the latter is in the active blocking position. The elastic tab 12*a* exhibits the shape of a substantially thin blade having deformation characteristics allowing exerting on the blocking means 12 a return force towards the rest position. Said elastic tab 12 exerts a stress lower than or even much lower than the spring of the blocker.

In both cases, the cam 11 has bearing surfaces able to contact the blocking means 12 so as to drive the latter to the rest position and to reset the elastic return means 14 via the stop 11*c*.

The blocking means 12 is in the standby position when said blocking means 12 is in contact with a face 11*a*, called<< standby protrusion>> of the cam. During the rotation of the opening lever, said contact disappears, which allows the blocking means 12 in order to finish the rotation until the active blocking position. The protrusion 11*a* allows moving backwards the blocking means 12 to the rest position during the return to the rest position. The blocking means 12 in the blocking position is bearing on the cam 11 which ensures a direct control of the overlap allowing a second protrusion 11*b*, called<< blocking protrusion>>, herein in the shape of a hook, to catch the blocking means 12 and thus to stop the movement of the opening lever 10.

Thus, the cam 11 includes a second protrusion 11*b*, of the hook type, formed by a stop of structure defining a recess intended for receiving a part 15 of blocking means 12 when the latter is in the active blocking position so as to block the movement of the opening lever 10.

The cam 11 may include more than two protrusions or even one single protrusion allowing the return of the blocking means from the blocking position to the rest position.

The trigger means 16 and the blocking means 12 may be each movable in rotation or in translation. In the context of the described examples, the trigger means 16 is movable in translation, in particular along an axis substantially collinear with the direction of the guiding axes of the plane formed by the cam 11. The blocking means 12 is movable in rotation along an axis of rotation substantially colinear with the axis of rotation of the cam 11.

Any other combination may be considered.

The trigger means 16 is thus configured so as to block any movement of the blocking means 12. To this end, the trigger means 16 may include a holding is protrusion 18 directly abutting substantially in or on a complementary notch 20 present in the blocking means 12. This geometry allows eliminating the manufacturing clearances of the blocking means and of the triggering means. In the rest position of the trigger means 16 and the blocking means 12, the blocking elastic return means 14 exerts a permanent torque on the holding protrusion 18 which aims to raise the blocking means 12 towards the blocking position.

The trigger means may be made in the form of a single piece or multiple pieces.

According to the shown embodiment, the trigger means 16 is associated with an unblocking elastic return means of its own, such as a compression spring 24, which allows a translation movement of said trigger means 16. The unblocking elastic return means 24 associated with the trigger means 16 is fastened on a fixed part of the lock 1 of the invention. The assembly formed by the trigger means 16 and the associated elastic return means 24 are disposed so as to be moved following the resulting inertial force of the lateral shock undergone by the lock 1 of the invention. In other words, in order to move the trigger means 16 and to release the blocking means 12, it is necessary that the inertial force in case of shock undergone by the door leaf is greater than the stiffness of the elastic return means 24, typically greater than the inertial stress resulting from the mass of the trigger means 16 to which is deduced the stiffness of the elastic return means 24.

Said unblocking elastic return 24 thus allows said trigger means 16 to hold the blocking means 12 in the rest position. In case of shock along the direction 3, said unblocking elastic return means, such as the spring 24, is therefore compressed, driving the trigger means 16 and releasing the blocking means 12. The trigger means 16 therefore reaches the active unblocking position. At the end of the shock, the spring 24 drives the trigger means 26 in the rest position.

The blocking means 12 is associated with the blocking elastic return means 14 which may be in the form of one or more springs, in particular in the shape of a spiral spring. In this last case, the spiral spring has an axis of rotation substantially coincident with that of the blocking means 12. The blocking elastic return means 14 is configured so as to operate by bringing the blocking means 12 from the rest position to the active blocking position in case of release of said blocking means 12 by the trigger means 16.

The lever may include a contact surface, in particular a stop (not shown) able to receive the end of the blocking elastic return means and to drive the latter so as to put the elastic return means back to the working position.

According to the embodiment of FIG. 4, the blocking elastic return means 14 includes one end 28 able to come under a stop 32 belonging to the blocking means 12.

The blocking means 12 can also exhibit a ramp 34 formed on the stop 32 so as to allow the positioning of the end 28 under the stop 32. The lever may also include a stop 13 which allows putting the end 28 back in compression and in position when the blocking means has been brought to the rest position.

The blocking means 12 passes from the active blocking position to the rest position, under the effect of its own weight or assisted by the torque generated by the flexible tab 12*a*. The stop 11*c* of the opening lever 10 allows finishing the return of the blocking means 12 in the rest position and the resetting via the trigger means, while allowing the placement of the spring under the face 28. Thanks to the part 11*d* of the cam 11, the elastic return means 14 is placed under the ramp 34 of the blocking means 12. The return of the blocking means 12 from the blocking position to the rest position is accompanied by putting the blocking elastic return means 14 back under tension through the stop 13. The blocking means 12 may include at least one elastic arm 39 configured to change the length of the blocking means 12. Said extension of the blocking means 12 allows releasing the blocking elastic return means 14 relative to the stop 32. The blocking elastic return means 14 no longer exerts therefore a torque on the blocking means 12. Said extension of the one or more elastic arms 39 can be performed when the blocking means 12 passes from the active blocking position to the rest position, in particular when said blocking means undergoes a significant traction of the opening lever 10 greater than a normal traction for door leaf opening by a user.

Each elastic arm 39 has deformation characteristics allowing regaining their original shape after elongation in the blocking position of the blocking means 12. Consequently, in order to take the end 28 of the blocking elastic return means out, it is appropriate to exert a traction on the opening lever 10 greater than the stiffness corresponding to the sum of that of each elastic arm 39.

Thus, in the active blocking position, when the opening lever 10 is pivoted to the opening direction, namely when a user acts on the cable driving said lever in order to open the door leaf 2, a pressure is exerted on the blocking means at the one or more protrusions of the cam 11 stretching the one or more elastic arm(s) 39. The length of the blocking means being larger, the end 28 of the elastic return means is released from the stop 32. The resetting is therefore performed thanks to the stop 13 belonging to the opening lever 10 which puts said end 28 back under the stop 32 by passing through the ramp 34.

The blocking means 12 may be disposed in the lock so that at each rotation of the lever in the opening direction of the door leaf, when said blocking means 12 is in the rest position, the elastic return means 14 is compressed. The permanent activation of the blocking means 12 avoids any blocking of the blocking means due to the aging of the lock. To do this, the blocking means 12 may be disposed away from the opening lever 10 and may be brought into contact when the opening lever is pivoted under the action of a door leaf normal opening.

The blocking means 12 may be made of a flexible material, such as acetal resin, in order to allow the deformation and the extension. The trigger member will be made of the material which will allow reaching the desired mass for the inertial triggering.

The kinematic following a lateral shock, for example that along the direction 3, will be now described in more details.

Figure 6A:
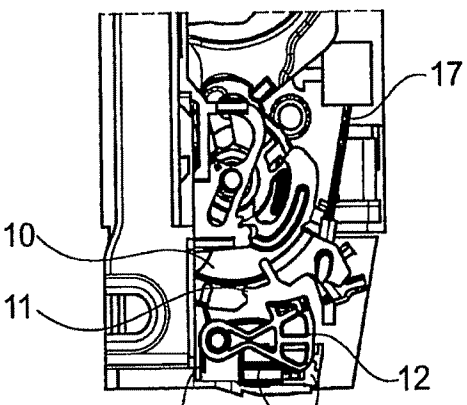

In the embodiment shown in FIG. 6*a*, the blocking means 12 and the trigger means 16 are both in the rest position. In this position, the rod or the cable 7 can pivot the cam 11 and allow the opening of the lock 1 of the invention without difficulty from the means of the blocking 12. As mentioned hereinabove, according to one embodiment, it is possible to have a contact between the blocking means 12 and the cam 11 so as to slightly compress without impeding the pivoting of the cam in order to guarantee the proper operation of the blocking means and to avoid any jamming of the latter, which leaves a possible opening of the lock.

In this position, the holding protrusion 18 of the triggering means is blocked in the notch 20.

The elastic return means 14 holds the blocking means 12 bearing against said trigger means 16.

Figure 6B:
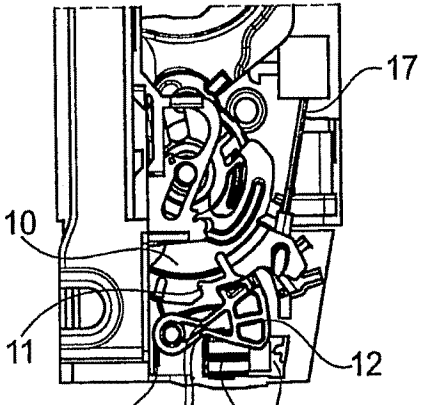

In the embodiment shown in FIG. 6*b*, the lock 1 of the invention undergoes a lateral shock along the direction 3. In this embodiment, under the effect of an inertial force applied to the trigger means 16 greater than the stiffness of the elastic return means 24, the trigger member 16 is displaced and releases the blocking means 16 which comes into contact with the cam 11 of the opening lever by being pivoted about its axis of rotation under the effect of its elastic return means 14.

The opening lever 10 can also undergo an acceleration and begin a rotation under the influence of a traction of the Bowden cable 40 and to open the door leaf 2, but the latter is stopped by the blocking means 12 as soon as the latter is in the blocking position. Thus, the part 15 of the blocking means 12 is gripped in the stop 11*c* thanks to the movement of the cam 11 along the direction of the opening of the door leaf.

Figure 6C:
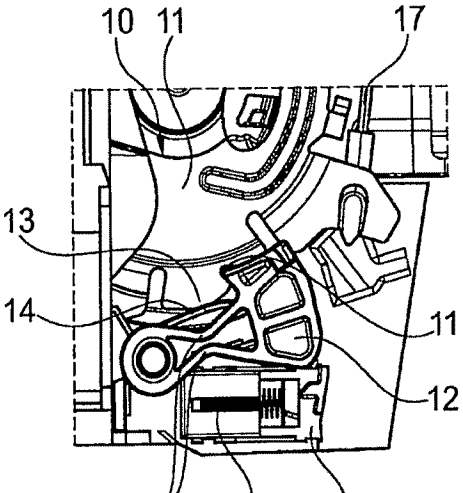

According to the embodiment shown in FIG. 6*c*, the blocking means 12 is housed in the recess of the protrusion 11*b* and blocks the opening lever 10. The lever 10 is thus stopped in the rotation that it had begun to perform by the blocking means 12.

If the shock 3 induces oscillations aiming to pivot the opening lever 10 in the direction of the opening of the door leaf 2, the latter typically have an intensity lower than the resulting stiffness of the one or more elastic arm(s) 39, so that the lever cannot be pivoted nor that the door leaf can be open.

However, in the case where the stress is greater than the resulting stiffness of the one or more elastic arm(s) 39, the blocking means 12 can extend under the traction of the opening lever 10, until reaching a stop 100 belonging to the fixed part of the lock of the invention.

Said stop 100 can be sized to withstand a significant and exceptionally applied stress.

Figure 6D:
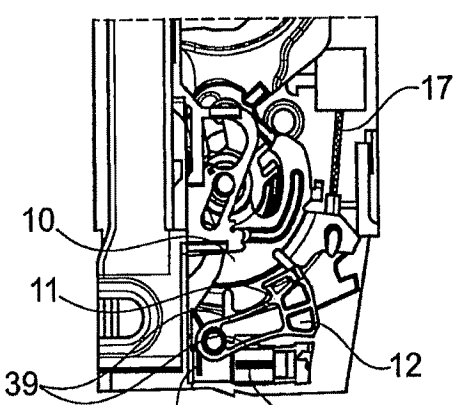

According to the embodiment of FIG. 6*d*, as soon as the acceleration becomes zero, the trigger means 16 is held in the blocking position of the cam 11 thanks to the elastic return means 24. This allows ensuring the permanent blocking regardless of the number of successive shocks undergone by the lock.

In order to release the blocking means 12 from its blocking position and to put it back into the rest position, a traction is imposed on the cable 7 so as to pivot the cam 11 with a force greater than the stiffness of the elastic arms 39 of the blocking means.

Thereby said blocking arms 39 take their working position, by stretching while increasing the length of the blocking means 12.

The elastic return means 14 blocked by its end 28 under the stop 32 is released from the latter. Said end thus comes against the stop 13 of the cam 11.

The blocking means 12 is thus stretched in opposition to the lever 10 and to stop on the recess of the protrusion 11*b*.

Figure 6E:
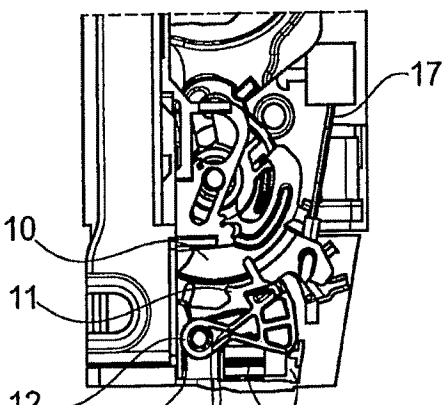

As shown in FIG. 6*e*, as soon as the lever 10 is pivoted in the opposite direction of the opening direction of the door leaf 2, the blocking means 12 is no longer in the stretched position because the arms 39 return back to their rest position. The blocking means 12 is available to return back to the rest position and to begin returning back to the rest position via the standby protrusion 11*a*.

Figure 6F:
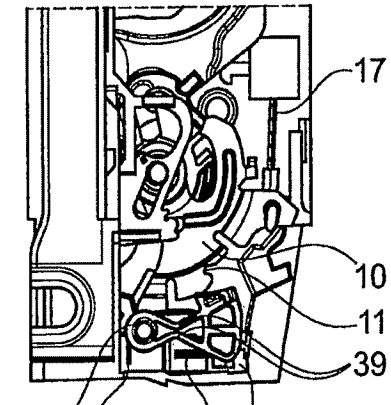

As shown in FIG. 6*f*, the next traction the cable 7 causes a rotation of the cam 11 and in particular of the second protrusion 11*b* which drives said blocking means 12 in its rest position. This movement can be assisted by the elastic tab 12*a*.

As shown in FIG. 6*f*, thanks to the protrusion 11*b*, the blocking means 12 is brought into the rest position by displacing the holding protrusion 18 in the complementary notch 20. The end 28 of the elastic return means is also placed under the stop 32 of the blocking means thereby putting the elastic return means 14 again in compression for the next shock. To do this, the end 28 of said elastic return means is guided by the ramp 34 until being blocked under the stop 32.

Thus advantageously, the lock of the invention includes a phase in which there is triggered the triggering member which releases the blocking means member under the impulse of an inertial stress, a blocking principle, which prevents the opening by blocking the opening lever, a principle for returning into the rest position and a principle for putting in movement in order to avoid the jamming.

The lock of the invention has the following advantages:

- the blocking of the opening in case of traction on the opening lever cable during an inertial shock with a blocking device independent of the environment of the lock,
- the blocking of the kinematic chain of the lock performed within the lock by avoiding any interaction with the members present in the door leaf,
- the triggering under the inertial effect coming from a shock or not,
- the triggering operating from an inertial stress threshold which is determined by the stiffness selected from the elastic return means of the trigger means and the mass of the trigger means,
- the displacement time of the blocking means of is constant since it depends on the elastic return means whose stiffness can be selected depending on the desired displacement time,
- the positioning of the blocking means and the trigger means has a high tolerance because the blocking is done by contact on areas which self-fit which allows limiting the operational chain.
- the putting back in the rest position is performed in a simple and reliable manner by an additional stress which may be performed by a user,
- the volume of the support on which the blocking means are fastened and the trigger means is reduced, which also allows reducing the manufacturing cost, the weight and optimizing the current volume of a lock.

The invention claimed is:

1. A lock for a door leaf of motor vehicle comprising:

an opening lever of said door leaf that allows the opening of the door leaf;

a blocking means configured to take an active blocking position in which said blocking means blocks said opening lever and a rest position in which said blocking means allows the movement of said opening lever;

a blocking elastic return means configured to switch said blocking means from the rest position to the active blocking position; and a trigger means configured to take a rest position in which said trigger means blocks the blocking means in its rest position and an active blocking position in which said trigger releases said blocking means so that the blocking means passes from the rest position to the active blocking position, the trigger means being arranged to move under the effect of an inertial force applied to the lock during an accident, the opening lever comprising a driving means configured to bring the blocking means from the active blocking position to the rest position when the opening lever is pivoted towards the direction of the opening of the door leaf, wherein the blocking means includes at least one elastic arm configured to change the length of the blocking means in order to disengage the blocking elastic return means of the blocking means.

2. The lock according to claim 1, wherein a cam supports the driving means in the form of a protrusion.

3. The lock according to claim 1, wherein a cam includes a protrusion, of the hook type, formed by a structural stop defining a recess configured for receiving a part of the blocking means when the blocking means is in the active blocking position so as to block the movement of the opening lever.

4. The lock according to claim 1, wherein the blocking elastic return means includes a first end able to come under a stop belonging to the blocking means and a second end able to be fastened on a fixed member of the lock.

5. The lock according to claim 4, wherein the blocking means includes a ramp allowing the blocking elastic return means to return under the stop when said blocking means passes from the active blocking position to the rest position.

6. The lock according to claim 5, wherein the protrusion is configured to receive the first end of the blocking elastic return means and to drive the blocking elastic return means under the stop of the blocking means when the blocking means has been brought into the rest position.

7. The lock according to claim 1, wherein the blocking means includes an elastic tab abutting against a fixed member of the lock and configured to exert a return force on the blocking means when the blocking means is in the active blocking position.

8. The lock according to claim 1, wherein the trigger means is associated with an unblocking elastic return means configured to allow the passage of the trigger means from the active unblocking position to the rest position.

9. The lock according to claim 8, wherein the trigger means is movable in translation through the elastic return means, such as a compression spring, fastened to the trigger means and to a fixed member of the lock.

10. The lock according to claim 1, wherein the trigger means includes a protrusion coming substantially in or on a complementary notch present in the blocking means.

11. The lock according to claim 1, wherein the blocking means is disposed in the lock in the rest position so that at each rotation of the opening lever in the direction of the opening of the door leaf and when the blocking means is in the rest position, the blocking means and the opening lever come into contact.

12. A motor vehicle including a door leaf and a lock according to claim 1 configured for opening and closing said door leaf.

* * * * *